US006788178B2

(12) United States Patent
Inase et al.

(10) Patent No.: US 6,788,178 B2
(45) Date of Patent: Sep. 7, 2004

(54) MAGNET ROLLER AND PROCESS FOR PREPARING THE SAME

(75) Inventors: Shingo Inase, Tochigi-ken (JP); Masami Hosokawa, Mooka (JP); Osamu Oshima, Mooka (JP); Masaharu Iwai, Mooka (JP)

(73) Assignees: Kaneka Corporation, Osaka-Fu (JP); Tochigi Kaneka Corporation, Tochigi-Ken (JP)

( * ) Notice: Subject to any disclaimer, the term of this patent is extended or adjusted under 35 U.S.C. 154(b) by 76 days.

(21) Appl. No.: 10/464,389

(22) Filed: Jun. 18, 2003

(65) Prior Publication Data

US 2003/0234712 A1 Dec. 25, 2003

(30) Foreign Application Priority Data

Jun. 20, 2002 (JP) ..... 2002-179939

(51) Int. Cl.[7] ..... H01F 7/02; G03G 15/09

(52) U.S. Cl. ..... 335/306; 29/607; 29/895.21; 399/277

(58) Field of Search ..... 335/302–306; 399/267–288; 29/607, 608, 895–895.33

(56) References Cited

U.S. PATENT DOCUMENTS 4,558,294 A * 12/1985 Yamashita ..... 335/303

* cited by examiner

*Primary Examiner*—Ramon M. Barrera
(74) *Attorney, Agent, or Firm*—Brinks Hofer Gilson & Lione

(57) ABSTRACT

A process for preparing a magnet roller comprising a plurality of bar-like magnet pieces in a high working efficiency and in an improved adhesion accuracy, which comprises the steps of regulating the bonding position of at least two magnet pieces by their outer peripheral surfaces and their end surfaces, applying an adhesive from the inner surface side of the magnet pieces to the adhesion faces of the magnet pieces for bonding one magnet piece to another magnet piece to form a magnet block, and bonding and fixing the magnet block to a shaft. At least one of the adhesion faces which are in contact with each other may have a plurality of grooves to facilitate penetration of the adhesive into the interface of adjacent two magnet pieces.

10 Claims, 6 Drawing Sheets

MAGNET ROLLER AND PROCESS FOR PREPARING THE SAME

RELATED APPLICATIONS

This application is related to and claims priority from Japanese Patent Application No. 2002-179939, filed on Jun. 20, 2002.

BACKGROUND OF THE INVENTION

The present invention relates to a magnet roller for use in electrophotographic devices such as copying machine, facsimile and laser printer, and a process for preparing a magnet roller.

A magnet roller which has been conventionally used in electrophotographic devices such as copying machine, facsimile and laser printer, has a plurality of magnetic poles on its surface and is scaled in a rotatable cylindrical sleeve so that the outer peripheral surface (outer surface) of the magnet roller does not come into contact with the inner peripheral surface (inner surface) of the sleeve.

Such magnet rollers are known, for instance, from JP-A-54-80755 which discloses a magnet roller for electrophotographic development using a permanent magnet body constructed by arranging block magnets around a shaft to form a plurality of magnetic poles in which a pair of adjacent two poles have the same polarity and the magnetic field strength at the intermediate position between the adjacent two poles is less than 1/10 of that of the adjacent two poles, and JP-A-59-166977 which discloses a magnet roller prepared by a process comprising the steps of magnetizing two magnetic pole-forming portions adjacent in the circumferential direction of a roll-shaped magnetic body in the same polarity by a single electromagnet extending over these adjacent portions, and concentrically and rotatably arranging a non-polar sleeve over the peripheral surface of the roll-shaped magnetic body.

In case of an integral-type magnet roller, it is necessary to form a plurality of magnetic poles on the magnet roller body. However, it is often difficult to form a plurality of magnetic poles on the magnet roller body in various magnetic force patterns, and there is a technical limit. Therefore, for the preparation thereof has been generally adopted a method in which magnet pieces having a magnetic force and a magnetization patter which are required to each of the pieces are separately prepared and adhered to a shaft so that the prepared magnet roller has a required predetermined magnetization pattern.

As shown in FIG. 2, a conventional procedure for bonding the magnet pieces is carried out by setting a shaft to an adhesion tool for regulating the bonding position with only the side face of a base magnet piece 2*a*, fitting the side face of magnet piece 2*a* to the adhesion tool, uniformly applying an instantaneous adhesive to the inner peripheral surface (inner surface) of the magnet pieces 2*a* in the longitudinal direction, and immediately pressing the inner surface of the magnet piece 2*a* against the shaft to adhere the magnet piece 2*a*. Magnet pieces 2*b* and 2*c* are then adhered onto the shaft one by one with fitting the position to that of the magnet piece 2*a*, thus bonding and fixing the magnet pieces to form a magnet roller.

This operation is not efficient and takes a time, since the magnet pieces are uniformly coated with an instantaneous adhesive in the longitudinal direction at their sides and inside peripheral surface and adhered to each other one by one with fitting them to the position of the base magnet piece 2*a*. Also, since adhesion accuracy is not good, it may invite lowering of the accuracy of pole positions. Further, since excessive adhesive overflows onto the outer peripheral surface and axial direction end surface of the magnet pieces, a work to remove the overflowed adhesive is required.

A primary object of the present invention is to solve problems as mentioned above and to provide a process for preparing a magnet roller in good working efficiency and high adhesion accuracy without overflowing excessive adhesive.

Another object of the present invention is to provide magnet rollers having a small variation in magnetization pattern between the magnet rollers.

These and other objects of the present invention will become apparent from the description hereinafter.

SUMMARY OF THE INVENTION

The present invention provides:

(1) a process for preparing a magnet roller comprising a plurality of magnet pieces, the process comprising the steps of regulating the bonding position of at least two magnet pieces by their outer peripheral surfaces and a part of their side surfaces, applying an adhesive from the inner surface side of the magnet pieces to the adhesion faces of the magnet pieces for bonding one magnet piece to another magnet piece to form a magnet block, and bonding and fixing the magnet block to a shaft;

(2) a process for preparing a magnet roller comprising a plurality of magnet pieces, the process comprising the steps of applying an adhesive from the inner surface side of at least two magnet pieces to the adhesion faces of the magnet pieces for bonding one magnet piece to another magnet piece to form a magnet block, and bonding and fixing the magnet block to a shaft, wherein at least one of the facing adhesion faces of the magnet pieces have a plurality of grooves having a width of 0.1 to 2 mm and a depth of 0.1 to 0.5 mm at an interval of 0.1 to 5 mm and extending in the direction from the inner surface side of the magnet piece toward the outer surface side thereof;

(3) the process of item (2), wherein the length of the grooves formed in the adhesion face is from 15 to 95% of the thickness of the magnet piece in its radial direction, and the grooves extend from the inner surface of the magnet piece;

(4) the process of item (2) or (3), wherein the grooves are formed simultaneously with extrusion for preparing the magnet pieces;

(5) the process of item (2), (3) or (4), wherein after the bonding position of at least two magnet pieces is regulated by their outer peripheral surfaces and a part of their side surfaces, the adhesive is applied from the inner surface side of the magnet pieces to the adhesion faces of the magnet pieces to form a magnet block, and the magnet block is adhered and fixed to the shaft;

(6) the process of any one of items (2) to (5), wherein the Vickers hardness of the magnet pieces is from 5 to 150;

(7) a magnet roller comprising a plurality of magnet pieces adhered to each other in a circumferential direction at their adhesion faces to form a cylindrical body, wherein grooves having a width of 0.1 to 2 mm and a depth of 0.1 to 0.5 mm are formed in at least one of the facing adhesion faces of the magnet pieces at an interval of 0.1 to 5 mm in a direction from the inner surface side to the outer surface side of the magnet piece;

(8) the magnet roller of item (7), wherein the length of the grooves formed in the adhesion face to extend from the inner surface side of the magnet piece toward the outer surface side thereof is from 15 to 95% of the thickness of the magnet piece in its radial direction, and the grooves extend from the inner surface of the magnet piece;

(9) the magnet roller of item (7) or (8), wherein the grooves are formed simultaneously with extrusion for preparing the magnet pieces;

(10) the magnet roller of item (7), (8) or (9), which is prepared by a process comprising the steps of regulating the bonding position of at least two magnet pieces by their outer peripheral surfaces and a part of their side surfaces, applying an adhesive from the inner surface side of the magnet pieces to the adhesion faces of the magnet pieces to form a magnet block, and bonding and fixing the magnet block to a shaft; and

(11) the magnet roller of any one of items (7) to (10), wherein the Vickers hardness of the magnet pieces is from 5 to 150.

According to the present invention, the adhesion time is shortened as compared with a conventional process, so the productivity is improved. Also, since a step between adjacent two magnet pieces, which may be formed when joining magnet pieces to each other, can be decreased, variation in magnetic force is decreased to about half of that in a conventional process. Since the gap between the magnet pieces is hard to be formed, variation in angle of magnetic pole becomes small. Further, problem due to slight variation in size of magnet pieces per se is eliminated by regulating the periphery of magnet pieces when joining them, and the torsion of magnet pieces is decreased, so magnet rollers of good quality can be obtained.

DETAILED DESCRIPTION

In the present invention, a magnet roller is prepared by regulating the bonding position of at least two bar-like magnet pieces by their outer peripheral surfaces and a part of their side surfaces, applying an adhesive from the inner surface side of the coupled magnet pieces to the adhesion faces of the magnet pieces for bonding one magnet piece to another magnet piece to form a magnet block, and bonding and fixing the magnet block to a shaft.

The bar-like magnet pieces have such a sector-like cross section that a cylinder is formed when the side faces of the bar-like magnet pieces are joined to one another. The term "a part of their side surfaces" as used above means, in case of magnet piece 21 shown in FIG. 1(*a*), a side face which is not the adhesion faces, namely an end face of the bar-like magnet piece, and may be a part of the end face so long as the positioning is possible.

A method for positioning and bonding the magnet pieces to each other and a method for bonding a shaft to a block of integrated magnet pieces will be explained below with reference to embodiments.

Figure 3:
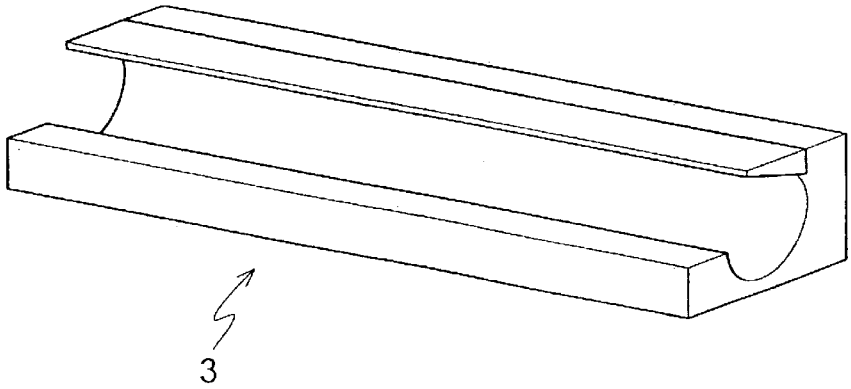
FIG. 3 is an illustrative view of an adhesion tool used in the present invention for regulating the periphery of a magnet roller to be prepared.

As a method for regulating the bonding position of magnet pieces by their outer peripheral surface and end face and bonding the magnet pieces to each other is preferred a method using adhesion tool 3 as shown in FIG. 3 having the same shape as that of the outer peripheral surface of the magnet pieces and capable of regulating the bonding position by the end faces of the magnet pieces. FIGS. 1(*a*) to 1(*d*) show a method for preparing a magnet roller by using an adhesion tool. The adhesion tool is made up such that the portions thereof to be brought into contact with the outer peripheral surface and end surface of a magnet piece are set to required bonding position and angle, and the positioning is performed by pressing magnet piece 21 against the adhesion tool 3 as shown in FIG. 1(*a*). The adhesion face (side face) of second magnet piece 22 is then exactly fitted to and pressed against the adhesion face (side face) of magnet piece 21 which has been positioned, as shown in FIG. 1(*b*). An adhesive 4 is then poured from the side of the inner surface, to which a shaft 1 is to be adhered, of the magnet pieces 21 and 22 so as to penetrate into the interface (s) between the adhesion faces of the magnet pieces 21 and 22, thus bonding and fixing the magnet pieces to form a block or a cylinder, as shown in FIG. 1(*c*).

If necessary to form a cylinder, a third magnet piece is then adhered to the second magnet piece in the same manner as above. The operation of pouring the adhesive may be conducted simultaneously with the adhesion of the first and second magnet pieces after positioning and fitting the first and second magnet pieces and then the third magnet piece to the adhesion tool (either efficient operation be selected). The adhesion of the fourth and later magnet pieces is also conducted in the same manner as above in consideration of working efficiency.

The adhesion of a shaft to a magnet block composed of a plurality of magnet pieces adhered to each other in a manner as mentioned above is conducted in a manner as explained below.

Usually shaft 1 has a D-cut portion (D shape in radial section) for regulating the angle of magnetic pole position at its end portion, and the magnetic pole position is adjusted by the D-cut portion.

After bonding a plurality of magnet pieces to each other as explained above, an adhesive is uniformly coated in the longitudinal direction to the inner surface of a block of integrated magnet pieces, and shaft 1 is adhered to the magnet block in a manner as pressing the shaft against the inner surface of the magnet block, as shown in FIG. 1(*d*). Shaft 1 may also be adhered and fixed to the magnet block in such a manner as fixing the position of shaft 1 at a predetermined angle and pressing the integrated magnet piece block against the shaft.

The above-mentioned adhesion method is more efficient and faster and enables to exactly adhere and fix the magnet pieces and the shaft, as compared with a conventional method wherein an adhesive is applied to individual magnet pieces and they are adhered to each other with fitting the position to a base magnet piece.

Also, since the periphery of magnet pieces is regulated, steps on the periphery of magnet roller which may generate due to subtle variation in size of magnet pieces, can be made small. Since surface wave in the longitudinal direction can be made small, the deviation of magnetic force in the longitudinal direction is decreased, whereby the magnetic property is improved.

Further, since the adhesion faces of magnet pieces are firstly brought into close contact with each other and then adhered to each other with an adhesive followed by adhesion of a shaft thereto, a gap between the magnet pieces can be made small (to about 10 $\mu$m or less in contrast to a gap of about 100 $\mu$m or less formed in the conventional method mentioned above) and, therefore, the accuracy in angle between magnetic poles can be improved.

Also, since the adhesion accuracy is improved as a result of using an adhesion tool, frequency that magnet pieces are joined in a twisted state is decreased, so the quality of magnet rollers is improved.

The application of an adhesive to the adhesion faces of the magnet pieces is preferably conducted so that the adhesive penetrates to the adhesion faces.

The application of an adhesive in such a manner as making the adhesive penetrate to the adhesion faces is preferably conducted by using a dispenser capable of making quantitative coating, although the application of an adhesive can be made by hand coating. In this case, the discharge rate, the discharge pressure and the like can be determined in compliance with the length, thickness and the like of magnet piece and shaft and are not particularly limited, provided that it is necessary to apply a proper amount of an adhesive so that the adhesive does not run off to the end surface in the axial direction of the magnet piece.

The proper amount of adhesive which does not run off to the end surface of the magnet pieces is usually from about 30 to about 200 g/m$^2$, especially about 50 to about 100 g/m$^2$, and is determined in accordance with the lengths, thicknesses of the magnet piece and shaft, the size of grooves formed in the magnet piece and the properties and viscosity of the adhesive.

A preferable adhesive to be applied between the magnet pieces is an instantaneous adhesive, e.g., a cyanoacrylate adhesive.

It is preferable that the viscosity of the adhesive to adhere the magnet pieces to each other is low, since the adhesive is applied to the inner surface of the mated magnet pieces so as to penetrate into the gap between the adhesion faces of the magnet pieces. If the viscosity is not more than 700 mPa·s at a working temperature (usually 20° C.), it is possible to use the adhesive. Preferably the viscosity is not more than 300 mPa·s. The lower limit of the viscosity is about 5 mPa·s from the viewpoint of availability. If the viscosity of adhesive is more than 700 mPa·s, it is difficult to cause the adhesive to penetrate into the gap.

An adhesive used for bonding and fixing the shaft to the magnet pieces includes, for instance, an acrylic adhesive, an epoxy adhesive and the like, in addition to a cyanoacylate adhesive. An adhesive suitable for the adhesion of the shaft and magnet pieces used is selected. The adhesives may be used alone or in combination thereof.

It is preferable that the amount of the adhesive used for the adhesion of the shaft to the magnet pieces is usually from 30 to 300 g/m$^2$, especially 50 to 150 g/m$^2$, from the viewpoint of adhesion property and cost. If the amount of the adhesive is too small, adhesion failure is easy to occur, and if the amount is too much, it is also difficult to perform the adhesion. It is also preferable from the viewpoint of easiness in application operation that the viscosity is usually from 5 to 700 mPa·s, especially 5 to 300 mPa·s, at the working temperature (usually 20° C.).

The material of the adhesion tool is not particularly limited, but a magnetic material such as iron is preferred, since a magnet piece is sucked by magnetic force when adapting the magnet piece to the adhesion tool, whereby the workability in making the adhesion tool hold the magnet pieces is raised. Of course, nonmagnetic materials or combination of magnetic material and nonmagnetic material can also be used without any problem.

In a preferable embodiment of the present invention, a magnet block having a semi-circular cross section is first prepared and thereto is adhered a shaft, and another magnet block having a semi-circular cross section is then prepared and adhered to the first magnet block and the shaft adhered thereto.

As the magnet pieces mentioned above can be used those magnetized as they are. Magnet pieces which have been magnetized and then demagnetized can also be used. In this case, the magnet pieces are subjected to magnetization treatment again after bonding and fixing to a shaft. The re-magnetization may be conducted with respect to each pole or may be conducted simultaneously with respect to all poles. The shape or the like of a magnetizing yoke used at that time is not particularly limited.

Known various magnetic powders can be used in the preparation of magnet pieces. In order to meet the demand of high magnetic flux density, a mixed magnetic powder of an isotropic rare earth magnetic powder and an anisotropic ferrite magnetic powder may be used for preparing the magnetic pieces.

As to the mixing ratio of the isotropic rare earth magnetic powder and the anisotropic ferrite magnetic powder, the content of the isotropic rare earth magnetic powder is from 10 to 90% by weight and the content of anisotropic ferrite magnetic powder is from 90 to 10% by weight (the total of the both powders being 100% by weight). A mixed powder composed of 20 to 80% by weight of the isotropic rare earth magnetic powder and 80 to 20% by weight of the anisotropic ferrite magnetic powder is preferred from the viewpoint that cost reduction of magnet rollers can be contemplated by decreasing the content of expensive the isotropic rare earth magnetic powder. If the content of the isotropic rare earth magnetic powder is smaller than the above range, the magnetic force on the same level as that of a conventional ferrite magnet is only obtained, since the proportion of the isotropic rare earth magnetic powder occupied in a magnet piece or an integrated magnet body becomes too small. If the content of the isotropic rare earth magnetic powder is larger than the above range, a high magnetic force can be obtained, in other words, a high magnetic flux density can be achieved, but there is a case where magnet pieces or an integrated magnet body is magnetized so that a pole having a magnetic force exceeding that required for a magnet roller is formed, and also the magnet roller becomes expensive since waste generates in the specification of magnet roller.

Examples of the isotropic rare earth magnetic powder are, for instance, R—Fe—N alloy, R—Fe—B alloy, R—Co alloy, R—Fe—Co alloy and the like, wherein R is a rare earth element. Of these, preferable is an exchange spring magnetic powder which includes a soft magnetic phase and a hard magnetic phase and which has a structure that magnetization of the both phases performs an exchange interaction.

The exchange magnetic property is a property such that a large amount of a soft magnetic phase is present in a magnet, and magnetization of crystal grain having a soft magnetic property and magnetization of crystal grain having a hard magnetic property are combined with each other by an exchange interaction, so the magnetization of the hard magnetic grain prevents the magnetization of the soft magnetic grain from inverting as if the soft magnetic phase is not present. Like this, in case that the residual magnetic flux density is large and a soft magnetic phase which has a small coercive force is contained in a large quantity, a magnet having a small coercive force and a high residual magnetic flux density is obtained.

Since the exchange spring magnetic powder has a low coercive force derived from the soft magnetic phase and a high residual magnetic flux density derived from the exchange interaction, a high magnetic force can be obtained. Also, it has a better oxidation resistance than a conventional rare earth magnetic powder and can prevent rust without surface covering such as metal plating. Further, it contains a large amount of a soft magnetic phase, the Curie point becomes high (not less than 400° C.) and, therefore, the working limit temperature is high (not less than 200° C.) and the temperature dependency of residual magnetization becomes small.

Preferable examples of the rare earth element R are Sm and Nb. In addition to them, Pr, Dy, Tb and the like can be used alone or in combination of two or more. In order to enhance the magnetic property by replacing a part of the above-mentioned Fe, one or more of elements such as Co, Ni, Cu, Zn, Ga, Ge, Al, Si, Sc, Ti, V, Cr, Mn, Zr, Nb, Mo, Tc, Ru, Rh, Pd, Ag, Cd, In, Sn, Hf, Ta, W, Re, Os, Ir, Pt, Au, Hg, Tl, Pb and Bi can be added.

As the exchange spring magnetic powder are preferred one using a R—Fe—B compound phase as a hard magnetic phase and a Fe phase or a Fe—B compound phase as a soft magnetic phase, and one using a R—Fe—N compound phase as a hard magnetic phase and a Fe phase as a soft magnetic phase. Preferable examples of the exchange spring magnetic powder are, for instance, Nb—Fe—B alloy (soft magnetic phase: Fe—B alloy or αFe), Sm—Fe—N alloy (soft magnetic phase: αFe), Nd—Fe—Co—Cu—Nb—B alloy (soft magnetic phase: Fe—B alloy, αFe or the like), Nd—Fe—Co alloy (soft magnetic phase: αFe or the like), and the like. Exchange spring magnetic powder such as $Nd_4Fe_{80}B_{20}$ alloy (soft magnetic phase: $Fe_3B$ or αFe) and $Sm_2Fe_{17}N_3$ alloy (soft magnetic phase: αFe) are particularly preferred from the viewpoints of lowering the coercive force (iHc) and increasing the residual magnetic flux density (Br).

The anisotropic ferrite magnetic powder includes, for instance, those having a chemical formula represented by $MO.nFe_2O_3$ wherein n is a natural number. In the formula, one or more of Sr, Ba and Pb are suitably used as the "M".

A magnetic powder such as anisotropic ferrite magnetic powder, preferably the mixed magnetic powder mentioned above, is mixed with a resin binder and molded into magnet pieces.

Examples of the resin binder are, for instance, thermoplastic resins such as vinyl chloride-vinyl acetate copolymer, ethylene-ethyl acrylate copolymer, polyamide resin, polystyrene resin, polyethylene terephthalate (PET), polybutylene terephthalate (PBT), polyphenylene sulfide (PPS), ethylene-vinyl acetate copolymer (EVA), ethylene-vinyl alcohol copolymer (EVOH), chlorinated polyethylene (CPE) and polyvinyl chloride (PVC), and thermosetting resins such as epoxy resin, phenol resin, urea resin, melamine resin, furan resin, unsaturated polyester resin and polyimide resin. These may be used alone or in admixture thereof. Of these, vinyl chloride-vinyl acetate copolymer is preferred from the viewpoint of cost.

The content of the magnetic powder is preferably from 50 to 95% by weight, especially 60 to 90% by weight, based on the total weight of the magnetic powder and the resin binder. If the content of the magnetic powder is less than 50% by weight, the magnetic property of magnet rollers is lowered due to shortage of magnetic powder and accordingly a desired magnetic force is hard to be obtained. If the content of the magnetic powder is more than 95% by weight, moldability to form magnet pieces is apt to be impaired due to shortage of a binder and the strength of magnetic pieces is markedly lowered.

In case of the molding to the magnet pieces, the anisotropic ferrite magnetic powder is oriented and magnetized in the direction of applying a magnetic field. On the other hand, the isotropic rare earth magnetic powder is only magnetized without being oriented.

In addition to the use of anisotropic ferrite magnetic powder alone or a mixed magnetic powder of anisotropic ferrite magnetic powder and isotropic rare earth magnetic powder, as the magnetic powder may be used isotropic ferrite magnetic powder alone, isotropic rare earth magnetic powder alone, anisotropic rare earth magnetic powder alone, a mixed magnetic powder of isotropic ferrite and anisotropic ferrite, a mixed magnetic powder of anisotropic ferrite powder and anisotropic rare earth magnetic powder, a mixed magnetic powder of isotropic ferrite powder and anisotropic rare earth magnetic powder, a mixed magnetic powder of isotropic ferrite powder and isotropic rare earth magnetic powder, and a mixed magnetic powder of anisotropic rare earth magnetic powder and isotropic rare earth magnetic powder.

Magnet pieces having desired shape and size are prepared from a composition comprising a magnetic powder and a resin binder, for example, by extrusion or injection molding, and magnet rollers are prepared by joining a plurality of magnet pieces in a manner as mentioned above.

The shaft used in the preparation of magnet rollers is not particularly limited, and any of conventionally used shafts can be used, e.g., shafts made of SUS or SUM.

Magnet pieces may have a plurality of grooves formed in at least one adhesion face thereof (namely either or both side faces of bar-like magnet piece). Explanation is given below with respect to a process for preparing a magnet roller comprising a shaft and a plurality of magnet pieces joined each other into a cylindrical form, which comprises the steps of applying an adhesive from the inner surface side of at least two magnet pieces to the adhesion faces of the magnet pieces to form a magnet block, and bonding and fixing the magnet block to a shaft, at least one of adjacent two magnet pieces having a plurality of grooves which have a width of 0.1 to 2 mm and a depth of 0.1 to 0.5 mm in the adhesion face at an interval of 0.1 to 5 mm and which extend from the inner surface side of the magnet piece toward the outer surface side thereof, and with respect to a magnet roller prepared by this process.

Figure 4:
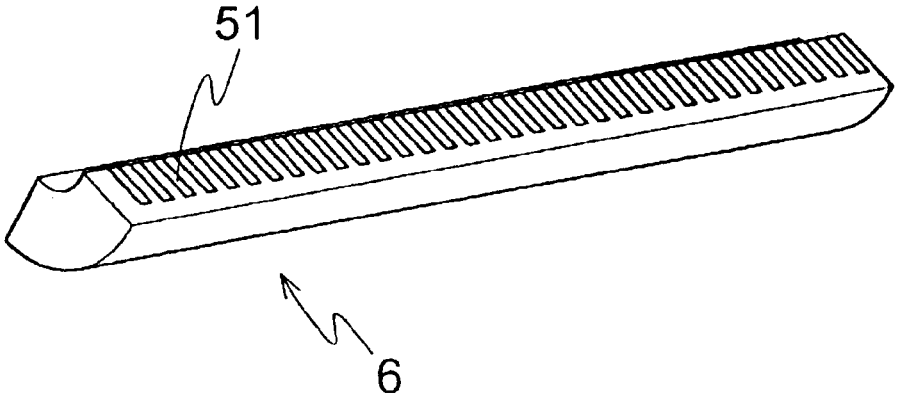
FIG. 4 is an illustrative view showing an example of a magnet piece having grooves used in the present invention.
Figure 5A:
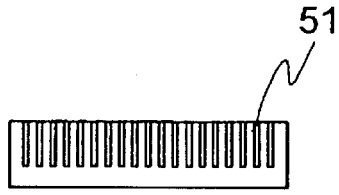
FIGS. 5(*a*) to 5(*f*) are illustrative views showing examples of grooves to be formed in the surface of magnet pieces used in the present invention.
Figure 5B:
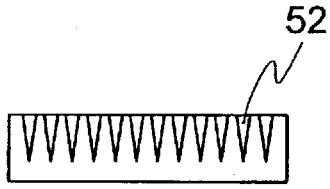
Figure 5C:
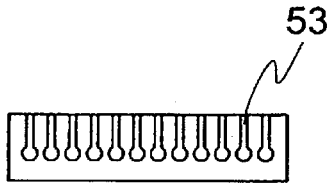
Figure 5D:
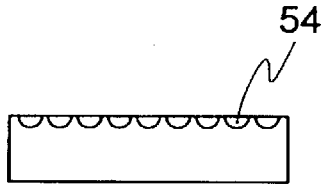
Figure 5E:
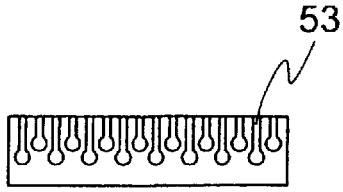
Figure 5F:
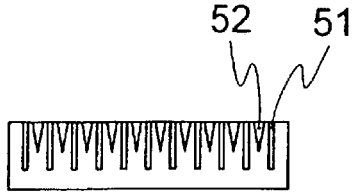

Grooves having a width of 0.1 to 2 mm, especially 0.4 to 1 mm and a depth of 0.1 to 0.5 mm, especially 0.1 to 0.4 mm and extending from the inner surface side of a magnet piece toward the outer surface side thereof are formed in the adhesion face of the magnet piece at an interval of 0.1 to 5 mm, especially 0.5 to 4 mm, for example, in a pectinate patter as shown in FIG. 4. Since magnet pieces 6 having grooves 51 as shown in FIG. 4 are used in this process, the process has the advantage that the penetration of an adhesive into the interface between the adhesion faces of mated two magnet pieces is enhanced when applying an adhesive from the inner surface side of the mated magnet pieces to the joint line, so the workability is markedly improved as compared with a conventional process which is troublesome in bonding magnet pieces one by one and, moreover, magnet rollers having an improved positioning accuracy of magnet pieces can be obtained.

If the interval between the adjacent grooves is less than 0.1 mm, it is difficult to form the grooves, and if the interval is more than 5 mm, peeling of the magnet pieces due to adhesion failure may occur. An interval of 5 mm or less is preferable for obtaining the effect produced by forming grooves. Also, if the width of each of the grooves is less than 0.1 mm, an adhesive is hard to penetrate through the grooves and, therefore, the effect of the grooves is not sufficiently obtained. On the other hand, if the width is more than 2 mm, unfavorable influence on magnetic force pattern is easy to appear. If the depth of the grooves is less than 0.1 mm, an adhesive is hard to penetrate through the grooves and, therefore, the effect of the grooves is not sufficiently obtained. If the depth is more than 0.5 mm, unfavorable influence on magnetic force pattern is easy to appear.

The "interval between the grooves" means the distance from the edge of a groove formed in the side face of a magnet piece to the edge of the next groove, namely the width of a non-grooved portion located between adjacent two grooves, and can be determined by measuring the distance between the edge of a groove which is visible on the side surface and the adjacent edge of the next groove. If the intervals of the grooves are not constant, the width of each of non-grooved portions present between ten adjacent grooves is measured and the average value thereof is found.

The "width of groove" means the width of a groove formed in the side surface of a magnet piece and can be obtained by measuring the width of a groove visible on the side surface. If the width of a groove is not constant, the groove extending from the open end to the closed end is divided into quarter sections, the width of the sections is measured at four points excepting the closed end and the average value thereof is found.

The "depth of groove" means the depth of a groove from the side surface of a magnet piece up to the bottom of the groove. If the depth of a groove is not constant, the groove extending from the open end to the closed end is divided into quarter sections, the depth of the sections is measured at four points excepting the closed end and the average value thereof is found.

FIGS. 5(*a*) to 5(*f*) show examples of the grooves to be formed in the side surface of magnet pieces used in the present invention. As shown in FIGS. 5(*a*) to 5(*f*), the shape of the groove may be any shape, such as rectangle 51, triangle 52, forward-rectangular backward-circular shape 53, semicircle 54 and combination of two or more of them. Also, all grooves formed are not necessarily required to have the same size and the same shape.

The grooves are formed extending from the inner surface of a magnet piece toward the outer surface thereof. It is preferable that the length of the grooves is from 15 to 95%, especially 20 to 90%, of the thickness of the magnet piece in its radial direction. Since the groove does not extend up to the outer surface of the magnet piece, an adhesive scarcely run off after bonding the magnet pieces and therefore the work to remove the adhesive run off is reduced. Also, no flaw is formed in the outer surface of the magnet pieces, magnetic force pattern is not adversely affected.

It is sufficient to form grooves in either adhesion face (either side surface) of a magnet piece, but the grooves may be formed in the both side surfaces of a magnet piece. In case that the grooves are formed in either side surface, it is easy to confirm the bonding direction of a magnet piece, and in case that the grooves are formed in both side surfaces, an adhesive is easy to penetrate into the interface between the adhesion faces of adjacent two magnet pieces.

The grooves may be formed over the full length of a magnet piece or may be formed in a part of the side surface of a magnet piece.

The grooves are formed in the direction from the inner surface of a magnet piece toward the outer surface thereof, but are not always required to be perpendicular to the longitudinal direction. The grooves may be formed, for example, in an oblique direction or in a lattice pattern, but it is not preferable to form the grooves so as to reach the outer surface of a magnet piece.

Figure 6:
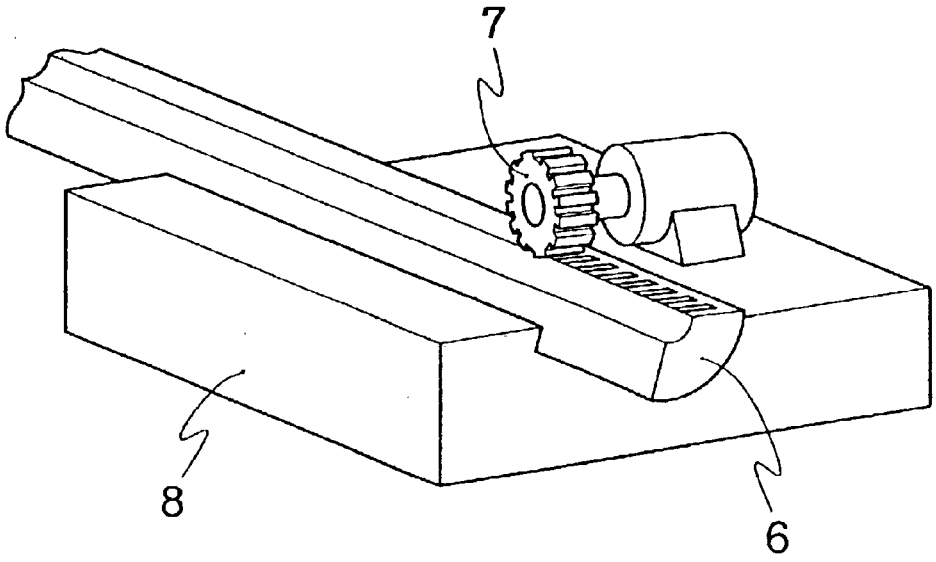
FIG. 6 is an illustrative view showing an example of a groove-forming device for forming grooves in magnet pieces used in the present invention.

The formation of grooves can be performed, for example, by using a groove-forming device as shown in FIG. 6. In case of forming the grooves subsequently to the molding of magnet pieces, the groove formation can be performed simultaneously with molding operation, for example, by disposing a groove-forming device in the vicinity of the outlet of an extruder 9 for molding magnet pieces and passing the extrudate through the groove-forming device.

A groove-forming device is usually disposed at a location through which a magnet piece molded by extrusion passes, and adjusted to location and angle for the grooves to be formed. The groove-forming device comprises a supporting member 8 and a gear 7 mounted on the supporting member 8. By passing a magnet piece 6 between the gear 7 and a supporting groove opposite to the gear teeth and provided in the surface of the supporting member 8, grooves of the same width and the same depth are press-notched at a constant interval.

The groove formation is not always required to perform in the vicinity of the outlet of the extrusion step. It may be performed with respect to each magnet piece as a post-process. For example, the grooves may be formed just before bonding magnet pieces to produce a magnet roller.

As to magnet pieces molded by other methods such as injection molding, too, the grooves can be formed after the molding in the same manner by using a groove-forming device as shown in FIG. 6.

It is preferable that the magnet pieces have a Vickers hardness of 5 to 150, especially 5 to 100, since the groove formation is easy. If the Vickers hardness is more than 150, the groove formation is difficult particularly when it is conducted by post-processing, since magnet pieces are too hard. If the Vickers hardness is less than 5, the magnet pieces are too soft and the groove formation is also difficult.

On the other hand, it is possible to produce magnet rollers by using magnet pieces having a Vickers hardness of more than 150 in combination with magnet pieces having a Vickers hardness of not more than 150. In this case, it is preferable that a magnet piece having a Vickers hardness of not more than 150 is provided with grooves in the side surface thereof and used in combination with a magnet piece of a Vickers hardness of more than 150 having no groove.

In case that a magnet roller is produced from magnet pieces having grooves as mentioned above by a process as mentioned above which comprises regulating the bonding position of at least two magnet pieces by their outer peripheral surfaces and their ends, applying an adhesive from the inner surface side of at least two magnet pieces to their adhesion faces for bonding one magnet piece to another magnet piece to form a magnet block, and bonding and fixing the magnet block to a shaft, the above-mentioned effects produced by the formation of grooves are obtained in addition to the above-mentioned effects produced by regulating the bonding position with the outer surface and end of a magnet piece and, therefore, magnet rollers having a good accuracy in magnetic pole position can be prepared in a good workability.

In a conventional process, magnet pieces are adhered and fixed to a shaft by coating both the side surface and the inner surface of a magnet piece with an instantaneous adhesive such as a cyanoacrylate adhesive, an acrylic adhesive or a two component adhesive such as an epoxy adhesive, and bonding the coated magnet piece to the shaft and the adjacent magnet piece which have been previously bonded to the shaft. This process has the disadvantage that excessive adhesive runs off onto the outer surface and end surface of the magnet pieces, so it is necessary to remove the adhesive run off after bonding the magnet pieces and the working efficiency is lowered. This problem can be solved by the process of the present invention as mentioned above wherein after positioning magnet pieces by the outer surface and end surface thereof, at least two magnet pieces are firstly bonded to each other by applying an adhesive to the inner surface of the mated magnet pieces so as to penetrate into the interface thereof and the resulting magnet block is then bonded and fixed to a shaft. Insufficient penetration of an adhesive into the interface of the mated magnet pieces which may be encountered when using magnet pieces having no grooves, results in insufficient adhesion strength between the adhesion faces of magnet pieces. The adhesion between the adhesion faces can be ensured by forming, in at least one side face of a magnet piece, grooves extending from the inner surface in the direction toward the outer surface of the magnet piece.

The positioning and bonding of magnet pieces having grooves are conducted in the same manner as above, as shown in FIGS. 1(*a*) to 1(*d*), to produce magnet rollers.

The adhesive, magnetic powder, resin binder, shaft, etc. used in the production of magnet rollers from magnet pieces having grooves are the same as above, provided that the amount of an adhesive used to bond the magnet pieces to each other is usually from 30 to 300 g/m$^2$, especially 50 to 150 g/m$^2$. The amount is larger than the case of bonding magnet pieces having no groove, but sure adhesion is achieved.

The magnet rollers produced in such a manner have a high performance, and the workability in the production is very good.

The present invention is more specifically described and explained by means of the following Examples and Comparative Examples in which all % are % by weight unless otherwise noted. It is to be understood that the present invention is not limited to the Examples.

EXAMPLE 1

Figure 1A:
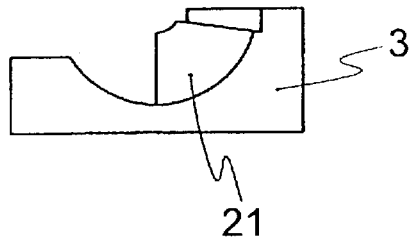
FIG. 1(*a*) is an illustrative view showing an embodiment according to the present invention wherein a first magnet piece is mounted onto an adhesion tool used in the present invention for preparing a magnet roller, FIG. 1(*b*) is an illustrative view showing an embodiment wherein a second magnet piece is mounted onto the adhesion tool, FIG. 1(*c*) is an illustrative view showing an embodiment wherein an instantaneous adhesive is applied to the magnet pieces mounted on the adhesion tool, and FIG. 1(*d*) is an illustrative view showing an embodiment wherein a shaft is adhered to the magnet pieces mounted on the adhesion tool.
Figure 1B:
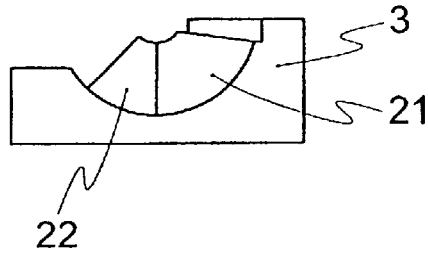
Figure 1C:
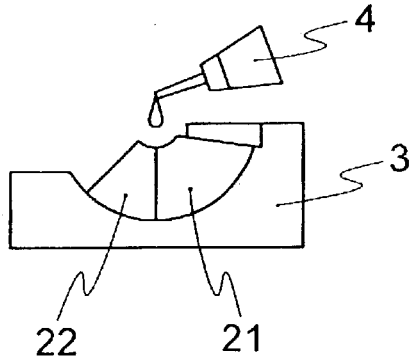
Figure 1D:
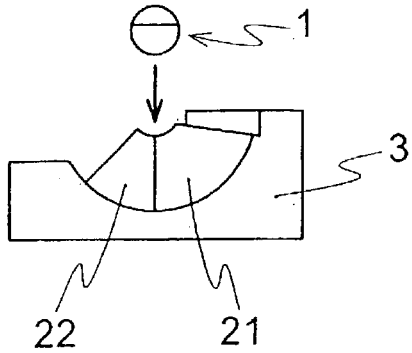
Figure 2:
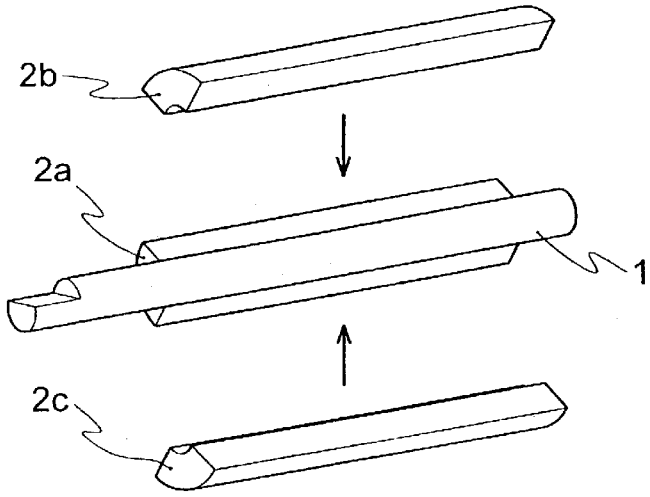
FIG. 2 PRIOR ART
FIG. 2 is an illustrative view showing a conventional method for bonding magnet pieces to a shaft to prepare a magnet roller.

Magnet pieces having a sector-like cross section, a thickness of 5.5 mm and a length of 330 mm as shown in FIG. 2 were prepared by mixing and melt-kneading 10% of a vinyl chloride-vinyl acetate copolymer (MB1008 made by Kaneka Corporation) as a resin binder and 90% of anisotropic strontium ferrite SrO.6Fe2O3 (NF110 made Nippon Bengara Kogyo Kabushiki Kaisha) as a magnetic powder to give pellets and extruding the pellets. Orientation magnetization of magnet pieces in a constant direction was also conducted in a magnetic field of 239 to 1,113 kA/m simultaneously with the preparation of the magnet pieces.

A five magnetic pole magnet roller was then prepared using the obtained magnet pieces (Vickers hardness 20) in a manner shown in FIG. 1 as follows:

Firstly, magnet piece 21 was fitted to adhesion tool 3 as shown in FIG. 3 with pressing the outer surface of magnet piece 21 against adhesion tool 3. Second magnet piece 22 was then mounted with matching to the side surface of the first magnet piece 21 and pressing the outer surface of magnet piece 22 against adhesion tool 3. A cyanoacrylate instantaneous adhesive (1782 made by Three Bond Co., Ltd., viscosity 80 mPa·s at 20° C.) was applied from the inner surface side of the mounted magnet pieces 21 and 22 to the joint line of the side surfaces of magnet pieces 21 and 22 in an amount of 80 g/m2 so as to penetrate into the interface, thereby integrating two magnet pieces 21 and 22. Third magnet piece was then mounted with matching to the side surface of the second magnet piece 22 and pressing the outer surface of third magnet piece against adhesion tool 3. A cyanoacrylate instantaneous adhesive (1782 made by Three Bond Co., Ltd.) was applied to the joint line of the side surfaces of the second and third magnet pieces in an amount of 80 g/m2 so as to penetrate into the interface, thereby bonding the third magnet piece to the integrated magnet pieces 21 and 22 to form a single block having a semi-circular cross section.

A cyanoacrylate instantaneous adhesive (1782 made by Three Bond Co., Ltd.) was uniformly coated to the inner surface of the block of integrated magnet pieces in the longitudinal direction in a proper amount (70 g/m2), and a shaft set at a desired angle was pressed from above against the coated surface to bond and fix the shaft to the magnet block.

Two magnet pieces for the remaining two magnetic poles were bonded in the same manner as above using the adhesion tool 3 to give a block of integrated magnet pieces. The obtained magnet block was adhered to the shaft to give a magnet roller by uniformly coating the adhesive to the side surfaces of the magnet block in an amount of 70 g/m2 for each side surface and uniformly coating the adhesive to the inner surface of the magnet block in an amount of 70 g/m2.

Twenty magnet rollers in total were prepared in the same manner as above, and the time from the starting of the adhesion up to the completion of the adhesion and the magnetic properties (torsion, variation in magnetic force in the longitudinal direction) were measured and evaluated (N=20).

The magnet properties were evaluated with respect to variation in magnetic force in the longitudinal direction, torsion angle and angle of magnetic pole by setting a magnet roller to a measuring instrument having a mechanism capable of holding the both end portions of the shaft of magnet roller and rotating the magnet roller, bring a measuring probe connected to a gauss meter near the roller up to a predetermined measuring position and measuring the magnetic force of the surface of the magnet roller while rotating the roller, and also by measuring the magnetic force of the surface of the magnet roller while moving the probe in the longitudinal direction of the roller in parallel with the roller. Also, it was observed whether the adhesive run off to the peripheral surface and both end surfaces of the roller.

The results are shown in Table 1 wherein average values from 20 samples are shown.

EXAMPLE 2

Seven magnetic pole magnet rollers were prepared and evaluated in the same manner as in Example 1. The results are shown in Table 1.

COMPARATIVE EXAMPLE 1

Magnet pieces were prepared in the same manner as in Example 1.

Using the obtained magnet pieces, 5 magnetic pole magnet rollers were prepared in a conventional manner as follows:

Firstly, a shaft was fitted to an adhesion tool at a predetermined angle. A cyanoacrylate instantaneous adhesive (1782 made by Three Bond Co., Ltd.) was uniformly coated to the inner surface of a base magnet piece in the longitudinal direction, and the coated inner surface was pressed against the shaft to adhere and fix to the shaft. The side surface (adhesion face) and inner surface of a second magnet piece were then uniformly coated with the cyanoacrylate instantaneous adhesive and were pressed against the adhesion face of the base magnet piece and the shaft with matching to them to adhere and fix.

Similarly, a third magnet piece was adhered and fixed to the shaft and the second magnet piece by uniformly coating the side surface (adhesion face) and inner surface of the third magnet piece with the cyanoacrylate instantaneous adhesive, and matching them to and pressing against the adhesion face of the second magnet piece and the shaft. A fourth magnet piece was then adhered and fixed to the shaft and the third magnet piece by uniformly coating the side surface (adhesion face) and inner surface of the fourth magnet piece with the cyanoacrylate instantaneous adhesive, and matching them to and pressing against the adhesion face of the third magnet piece and the shaft. A fifth magnet piece was further adhered and fixed to the shaft and the fourth magnet piece by uniformly coating the side surface (adhesion face) and inner surface of the fifth magnet piece with the cyanoacrylate instantaneous adhesive, and matching them to and pressing against the adhesion face of the fourth magnet piece and the shaft.

Twenty magnet rollers in total were prepared in this manner by coating magnet pieces with the adhesive and bonding to the shaft one by one.

The time from the starting of the adhesion up to the completion of the adhesion and the magnetic properties (torsion, variation in magnetic force in the longitudinal direction) were measured and evaluated (N=20). Also, in the observation whether the adhesive run off to the peripheral surface and both end surfaces of the roller, it was found for all of twenty magnet rollers that the adhesive run off, and removal thereof was necessary.

The results are shown in Table 1.

TABLE 1

| | Ex. 1 | Ex. 2 | Com. Ex. 1 |
|---|---|---|---|
| Adhesion time (second) | 90 | 130 | 120 |
| Maximum variation in magnetic force in longitudinal direction (mT) | 2 | 3 | 5 |
| Maximum torsion angle (end to center) (degree) | 0–1 | 0–2 | 1–4 |
| Maximum variation in angle of magnetic pole (degree) | 0–1 | 0–2 | 1–4 |
| Overflow of adhesive | no | no | yes |

EXAMPLE 3

Figure 7:
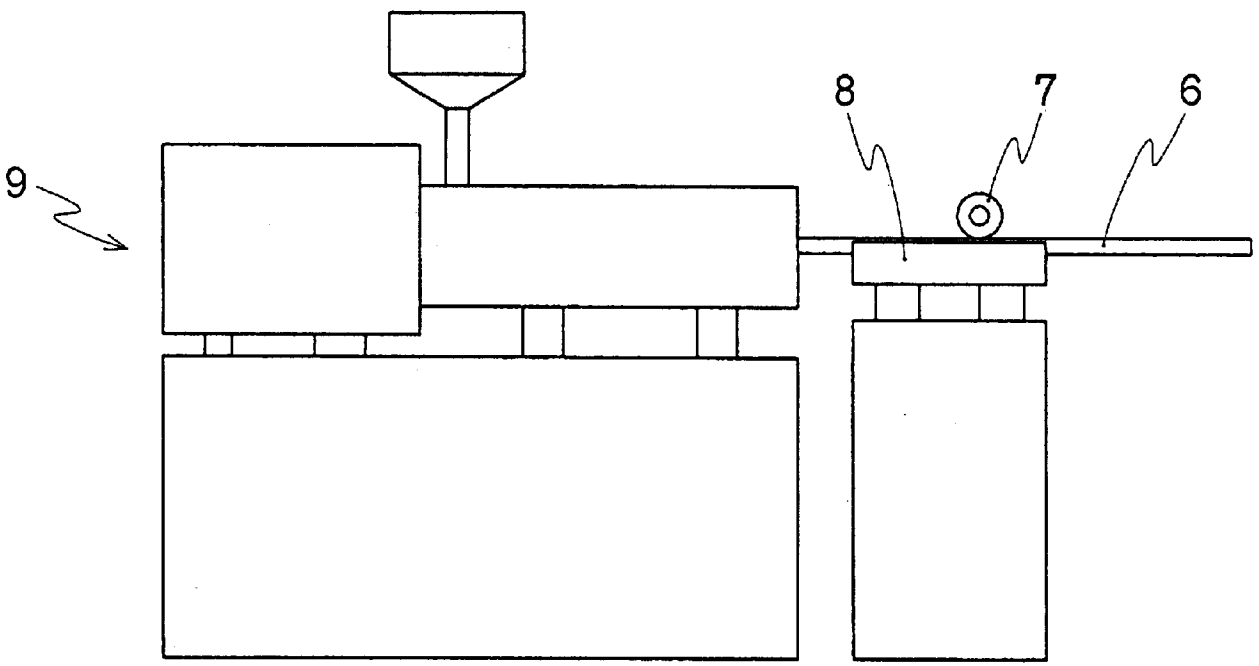
FIG. 7 is an illustrative view showing an example of arrangement of an extruder for forming magnet pieces and a groove-forming device for forming grooves in the magnet pieces.

Magnet pieces as shown in FIG. 4 were prepared by mixing and melt-kneading 10% of a vinyl chloride-vinyl acetate copolymer (MB1008 made by Kaneka Corporation) as a resin binder and 90% of anisotropic strontium ferrite $SrO.6Fe_2O_3$ (NF110 made Nippon Bengara Kogyo Kabushiki Kaisha) as a magnetic powder to give pellets and extruding the pellets, while forming rectangular grooves each having a width of 0.4 mm, depth of 0.15 mm and a length of 2.5 mm (=54% of the width 4.6 mm of the adhesion face) at an interval of 1.7 mm in one of the adhesion faces by a groove-forming device disposed near the exit of an extruder as shown in FIG. 7. Orientation magnetization of magnet pieces in a constant direction was also conducted in a magnetic field of 239 to 1,113 kA/m simultaneously with the preparation of the magnet pieces.

A five magnetic pole magnet roller was then prepared using the obtained magnet pieces (Vickers hardness 20) in a manner shown in FIG. 1 as follows:

Firstly, a first magnet piece was fitted to adhesion tool 3 with pressing the outer surface of the magnet piece against the adhesion tool. A second magnet piece was then mounted with matching to the adhesion face (side surface) of the first magnet piece and pressing the outer surface of the second magnet piece against the first magnet piece and the adhesion tool. A cyanoacrylate instantaneous adhesive (3000 made by Cemedyne Kabushiki Kaisha, viscosity 10 mPa·s at 20° C.) was applied from the inner surface side of the mounted magnet pieces to the joint line of the side surfaces of the magnet pieces in an amount of 90 $g/m^2$ so as to penetrate into the interface, thereby integrating two magnet pieces. A third magnet piece was then mounted with matching to the side surface of the second magnet piece and pressing the outer surface of the third magnet piece against the adhesion tool. The cyanoacrylate instantaneous adhesive (3000 made by Cemedyne Kabushiki Kaisha) was applied to the joint line of the side surfaces of the second and third magnet pieces in an amount of 90 $g/m^2$ so as to penetrate into the interface, thereby bonding the third magnet piece to the previously integrated magnet pieces to form a single block having a semi-circular cross section.

A cyanoacrylate instantaneous adhesive (3000 made by Cemedyne Kabushiki Kaisha) was uniformly coated to the inner surface of the block of integrated magnet pieces in the longitudinal direction in a proper amount (70 $g/m^2$), and a shaft set at a desired angle was pressed from above against the coated surface to bond and fix the shaft to the magnet block.

Two magnet pieces for the remaining two magnetic poles were bonded in the same manner as above using the adhesion tool 3 to give a block of integrated magnet pieces. The obtained magnet block was adhered to the shaft to give a magnet roller by uniformly coating the adhesive to the both side surfaces of the magnet block in an amount of 80 $g/m^2$ for each side surface and uniformly coating the adhesive to the inner surface of the magnet block in an amount of 70 $g/m^2$.

Twenty magnet rollers in total were prepared in the same manner as above, and they were evaluated (N=20) with respect to time from the starting of the adhesion up to the completion of the adhesion, number of magnet rollers which required adhesive-removing work, adhesion property of magnet rollers which had been subjected to environmental test, and magnetic properties.

The adhesion property of magnet rollers which had been subjected to environmental test were evaluated by subjecting magnet rollers to an environmental test of a heat cycle of −40° C. for 3 hours and 70° C. for 3 hours 40 times and counting the number of magnet rollers which caused peeling of magnet pieces.

The magnet properties were evaluated in the same manner as in Example 1.

The results are shown in Table 2, wherein the adhesion time was shown as a ratio to the adhesion time of Comparative Example 2.

EXAMPLE 4

Magnet pieces as shown in FIG. 4 were prepared by mixing and melt-kneading 10% of a vinyl chloride-vinyl acetate copolymer (MB1008 made by Kaneka Corporation) as a resin binder and 90% of anisotropic strontium ferrite $SrO.6Fe_2O_3$ (NF110 made Nippon Bengara Kogyo Kabushiki Kaisha) as a magnetic powder to give pellets and extruding the pellets, while forming rectangular grooves each having a width of 1.0 mm, depth of 0.4 mm and a length of 4.1 mm (=89% of the width 4.6 mm of the adhesion face) at an interval of 4.0 mm in one of the adhesion faces by a groove-forming device disposed near the exit of an extruder. Orientation magnetization of magnet pieces in a constant direction was also conducted in a magnetic field of 239 to 1,113 kA/m simultaneously with the preparation of the magnet pieces.

A five magnetic pole magnet roller was then prepared using the obtained magnet pieces (Vickers hardness 20) in a manner shown in FIG. 1 as follows:

Firstly, a first magnet piece was fitted to adhesion tool 3 with pressing the outer surface of the magnet piece against the adhesion tool 3. A second magnet piece was then mounted with matching to the adhesion face (side surface) of the first magnet piece and pressing the outer surface of the second magnet piece against the first magnet piece and the adhesion tool. A cyanoacrylate instantaneous adhesive (3000 made by Cemedyne Kabushiki Kaisha) was applied from the inner surface side of the mounted magnet pieces to the joint line of the side surfaces of the magnet pieces in an amount of 90 g/m$^2$ so as to penetrate into the interface, thereby integrating two magnet pieces. A third magnet piece was then mounted with matching to the side surface of the second magnet piece and pressing the outer surface of the third magnet piece against the adhesion tool. The cyanoacrylate instantaneous adhesive (3000 made by Cemedyne Kabushiki Kaisha) was applied to the joint line of the side surfaces of the second and third magnet pieces in an amount of 90 g/m$^2$ so as to penetrate into the interface, thereby bonding the third magnet piece to the previously integrated magnet pieces to form a single block.

A cyanoacrylate instantaneous adhesive (3000 made by Cemedyne Kabushiki Kaisha) was uniformly coated to the inner surface of the block of integrated magnet pieces in the longitudinal direction in a proper amount (70 g/m$^2$), and a shaft set at a desired angle was pressed from above against the coated surface to bond and fix the shaft to the magnet block.

Two magnet pieces for the remaining two magnetic poles were bonded in the same manner as above using the adhesion tool 3 to give a block of integrated magnet pieces. The obtained magnet block was adhered to the shaft to give a magnet roller by uniformly coating the adhesive to the both side surfaces of the magnet block in an amount of 80 g/m$^2$ for each side surface and uniformly coating the adhesive to the inner surface of the magnet block in an amount of 70 g/m$^2$.

Twenty magnet rollers in total were prepared in the same manner as above, and they were evaluated (N=20) with respect to time from the starting of the adhesion up to the completion of the adhesion, number of magnet rollers which required adhesive-removing work, adhesion property of magnet rollers which had been subjected to environmental test, and magnetic properties.

The results are shown in Table 2.

EXAMPLE 5

Magnet pieces as shown in FIG. 4 were prepared by mixing and melt-kneading 10% of a vinyl chloride-vinyl acetate copolymer (MB1008 made by Kaneka Corporation) as a resin binder and 90% of anisotropic strontium ferrite $SrO.6Fe_2O_3$ (NF110 made Nippon Bengara Kogyo Kabushiki Kaisha) as a magnetic powder to give pellets and extruding the pellets, while forming rectangular grooves each having a width of 0.5 mm, depth of 0.2 mm and a length of 1.0 mm (=21% of the width 4.6 mm of the adhesion face) at an interval of 1.0 mm in one of the adhesion faces by a groove-forming device disposed near the exit of an extruder. Orientation magnetization of magnet pieces in a constant direction was also conducted in a magnetic field of 239 to 1,113 kA/m simultaneously with the preparation of the magnet pieces.

A five magnetic pole magnet roller was then prepared using the obtained magnet pieces (Vickers hardness 20) in a manner shown in FIG. 1 as follows:

Firstly, a first magnet piece was fitted to adhesion tool 3 with pressing the outer surface of the magnet piece against the adhesion tool 3. A second magnet piece was then mounted with matching to the adhesion face (side surface) of the first magnet piece and pressing the outer surface of the second magnet piece against the first magnet piece and the adhesion tool. A cyanoacrylate instantaneous adhesive (3000 made by Cemedyne Kabushiki Kaisha) was applied from the inner surface side of the mounted magnet pieces to the joint line of the side surfaces of the magnet pieces in an amount of 90 g/m$^2$ so as to penetrate into the interface, thereby integrating two magnet pieces. A third magnet piece was then mounted with matching to the side surface of the second magnet piece and pressing the outer surface of the third magnet piece against the adhesion tool. The cyanoacrylate instantaneous adhesive (3000 made by Cemedyne Kabushiki Kaisha) was applied to the joint line of the side surfaces of the second and third magnet pieces in an amount of 90 g/m$^2$ so as to penetrate into the interface, thereby bonding the third magnet piece to the previously integrated magnet pieces to form a single block.

A cyanoacrylate instantaneous adhesive (3000 made by Cemedyne Kabushiki Kaisha) was uniformly coated to the inner surface of the block of integrated magnet pieces in the longitudinal direction in a proper amount (70 g/m$^2$), and a shaft set at a desired angle was pressed from above against the coated surface to bond and fix the shaft to the magnet block.

Two magnet pieces for the remaining two magnetic poles were bonded in the same manner as above using the adhesion tool 3 to give a block of integrated magnet pieces. The obtained magnet block was adhered to the shaft to give a magnet roller by uniformly coating the adhesive to the both side surfaces of the magnet block in an amount of 80 g/m$^2$ for each side surface and uniformly coating the adhesive to the inner surface of the magnet block in an amount of 70 g/m$^2$.

Twenty magnet rollers in total were prepared in the same manner as above, and they were evaluated (N=20).

The results are shown in Table 2.

COMPARATIVE EXAMPLE 2

Five magnetic pole magnet rollers were prepared in the same manner as in Comparative Example 1 except that a cyanoacrylate instantaneous adhesive (3000 made by Cemedyne Kabushiki Kaisha) was used instead of the cyanoacrylate instantaneous adhesive (1782 made by Three Bond Co., Ltd.). The magnet rollers were evaluated in the same manner as in Example 3

The results are shown in Table 2.

TABLE 2

| | Ex. 3 | Ex. 4 | Ex. 5 | Com. Ex. 2 |
|---|---|---|---|---|
| Adhesion time (%) | 83 | 82 | 82 | 100 |
| Number of rollers requiring work to remove adhesive | 0/20 | 0/20 | 0/20 | 20/20 |
| Adhesion property of roller after environmental test (number of rollers that caused peeling) | 0/20 | 0/20 | 0/20 | 0/20 |
| Maximum torsion angle (end-center) (degree) | 0–1 | 0–1 | 0–1 | 1–4 |
| Maximum variation in magnetic force in the longitudinal direction of roller (mT) | 1.5 | 2.0 | 2.8 | 5.0 |
| Maximum variation in angle of magnetic pole degree | 0–1 | 0–1 | 0–1 | 1–4 |

From Table 2, it is found that the process of Examples 3 to 5 can shorten the time of the adhesion step by about 20% as compared with the process of Comparative Example 2, and it is possible to further shorten the total time for the preparation of magnet rollers since the adhesive removal working is not required. The magnet rollers obtained in Comparative Example 2 have a strong adhesion strength since the adhesion faces are directly coated with an instantaneous adhesive, but the magnet rollers obtained in Examples 3 to 5 also have an adhesion strength on the same level. Whereas the torsion angle of magnet rollers prepared in Comparative Example 2 is from 1 to 4°, the torsion of magnet rollers scarcely occurs in Examples 3 to 5 as apparent from the result that the maximum torsion angle is from 0 to 1° and, therefore, it would be understood that the defect of a conventional process in this respect is improved. It would also be understood that according to the present invention, the variation in magnetic force in the longitudinal direction of magnet roller is suppressed to small values and the deviation in angle of magnetic pole scarcely occurs.

What is claimed is:

1. A process for preparing a magnet roller comprising a plurality of bar-like magnet pieces, said process comprising the steps of regulating the bonding position of at least two magnet pieces by their outer peripheral surfaces and their end surfaces, applying an adhesive from the inner surface side of the magnet pieces to the adhesion faces of the magnet pieces for bonding one magnet piece to another magnet piece to form a magnet block, and bonding and fixing the magnet block to a shaft.

2. A process for preparing a magnet roller comprising a plurality of bar-like magnet pieces, said process comprising the steps of applying an adhesive from the inner surface side of at least two magnet pieces to the adhesion faces of the magnet pieces for bonding one magnet piece to another magnet piece to form a magnet block, and bonding and fixing the magnet block to a shaft, wherein at least one of the facing adhesion faces of the magnet pieces have a plurality of grooves having a width of 0.1 to 2 mm and a depth of 0.1 to 0.5 mm at an interval of 0.1 to 5 mm and extending in the direction from the inner surface side of the magnet piece toward the outer surface side thereof.

3. The process of claim 2, wherein the length of the grooves formed in the adhesion face is from 15 to 95% of the thickness of the magnet piece in its radial direction, and the grooves extend from the inner surface of the magnet piece.

4. The process of claim 2, wherein the grooves are formed simultaneously with extrusion for preparing the magnet pieces.

5. The process of claim 2, wherein after the bonding position of at least two magnet pieces is regulated by their outer peripheral surfaces and their end surfaces, the adhesive is applied from the inner surface side of the magnet pieces to the adhesion faces of the magnet pieces to form a magnet block, and the magnet block is adhered and fixed to the shaft.

6. The process of claim 2, wherein the Vickers hardness of the magnet pieces is from 5 to 150.

7. A magnet roller comprising a plurality of magnet pieces adhered to each other in a circumferential direction at their adhesion faces to form a cylindrical body, wherein grooves having a width of 0.1 to 2 mm and a depth of 0.1 to 0.5 mm are formed in at least one of the facing adhesion faces of the magnet pieces at an interval of 0.1 to 5 mm in a direction from the inner surface side to the outer surface side of the magnet piece.

8. The magnet roller of claim 7, wherein the length of the grooves formed in the adhesion face to extend from the inner surface side of the magnet piece toward the outer surface side thereof is from 15 to 95% of the thickness of the magnet piece in its radial direction, and the grooves extend from the inner surface of the magnet piece.

9. The magnet roller of claim 8, wherein the grooves are formed simultaneously with extrusion for preparing the magnet pieces.

10. The magnet roller of claim 7, which is prepared by a process comprising the steps of regulating the bonding position of at least two magnet pieces by their outer peripheral surfaces and their end surfaces, applying an adhesive from the inner surface side of the magnet pieces to the adhesion faces of the magnet pieces to form a magnet block, and bonding and fixing the magnet block to a shaft.

* * * * *